US009476229B2

(12) United States Patent
Avganim

(10) Patent No.: US 9,476,229 B2
(45) Date of Patent: Oct. 25, 2016

(54) SECURITY STRIP DEFINING A SECURITY SLOT AND ATTACHABLE TO MOBILE ELECTRONIC DEVICES

(71) Applicant: Meir Avganim, Gealya (IL)

(72) Inventor: Meir Avganim, Gealya (IL)

( * ) Notice: Subject to any disclaimer, the term of this patent is extended or adjusted under 35 U.S.C. 154(b) by 44 days.

(21) Appl. No.: 14/305,298

(22) Filed: Jun. 16, 2014

(65) Prior Publication Data

US 2014/0366593 A1 Dec. 18, 2014

Related U.S. Application Data

(60) Provisional application No. 61/836,343, filed on Jun. 18, 2013.

(51) Int. Cl.
*E05B 73/00* (2006.01)

(52) U.S. Cl.
CPC ..... *E05B 73/0082* (2013.01); *E05B 73/0005* (2013.01); *Y10T 70/5009* (2015.04)

(58) Field of Classification Search
CPC ..... E05B 73/0005; E05B 73/0082; Y10T 70/5009
USPC ..... 70/14, 58
See application file for complete search history.

(56) References Cited

U.S. PATENT DOCUMENTS

| | | | | |
|---|---|---|---|---|
| 3,672,190 | A * | 6/1972 | Palazzolo | 70/58 |
| 5,487,523 | A * | 1/1996 | Ingram et al. | 248/551 |
| 5,502,989 | A * | 4/1996 | Murray et al. | 70/58 |
| 7,487,652 | B2 * | 2/2009 | Marszalek et al. | 70/58 |
| 7,971,458 | B2 * | 7/2011 | Gilbert | 70/58 |
| 2011/0203327 | A1 * | 8/2011 | Fong | 70/14 |
| 2012/0008277 | A1 * | 1/2012 | Wang et al. | 361/679.57 |
| 2012/0222458 | A1 * | 9/2012 | Avganim | 70/58 |
| 2012/0234055 | A1 * | 9/2012 | Bland et al. | 70/15 |
| 2013/0180295 | A1 * | 7/2013 | Avganim | 70/58 |
| 2014/0013809 | A1 * | 1/2014 | Marshall et al. | 70/18 |
| 2014/0085788 | A1 * | 3/2014 | Avganim | 361/679.01 |
| 2014/0118930 | A1 * | 5/2014 | Sedon | 361/679.56 |
| 2014/0124644 | A1 * | 5/2014 | Wong et al. | 248/553 |
| 2014/0130554 | A1 * | 5/2014 | Su | 70/15 |
| 2014/0260443 | A1 * | 9/2014 | Grziwok et al. | 70/62 |
| 2014/0318193 | A1 * | 10/2014 | Lin | 70/58 |
| 2014/0326027 | A1 * | 11/2014 | Avganim | 70/275 |
| 2015/0147109 | A1 * | 5/2015 | McCarter, Jr. | 403/164 |

* cited by examiner

*Primary Examiner* — Eret McNichols
(74) *Attorney, Agent, or Firm* — Ostrolenk Faber LLP

(57) ABSTRACT

A security strip or stick-on tab is attachable to the underneath of a very thin tablet or notebook device, with very little thickness added at the bottom of the device and not interfering with its resting on a flat surface. The strip or stick-on tab has a section protruding from underneath which becomes thickened and defines a standard security slot into which a lock with a cable are attachable to enable the cable to be irremovably attached to an immobile object, such as a chair or a desk, preventing theft of the secured device.

4 Claims, 3 Drawing Sheets

SECURITY STRIP DEFINING A SECURITY SLOT AND ATTACHABLE TO MOBILE ELECTRONIC DEVICES

CROSS-REFERENCE TO RELATED APPLICATION

This application claims benefit of and priority to U.S. Provisional Application Ser. No. 61/836,343 filed Jun. 18, 2013, the contents of which are incorporated herein by reference.

BACKGROUND OF THE INVENTION

The present invention is generally directed to security systems for light, mobile electronic devices and, more particularly, to a security strip which is attachable to the bottom of a mobile device and/or to glue-on sticks which define a security slot therein.

In laptop, notebook and the modern iPad® and tablet devices, it has become almost standard to provide a security slot into which a locking element can be inserted, which allows tethering of the mobile device to an immovable object, such as to a chair or a desk, to prevent theft of the mobile device. The standard security slot is a 3×7 mm throughgoing hole, into which a T-shaped locking bar is inserted and rotated inside the slot and so locks the mobile device to the immovable object. The prior on this type of lock is quite extensive and exemplified by U.S. Pat. Nos. 6,244,082, 5,502,898, and 5,493,878 the contents of which are incorporated herein by reference. Also incorporated by reference are the contents of U.S. patent application Ser. No. 13/818,557 of the present inventor.

More recently, the thicknesses of mobile devices, for example, the Apple notebook and tablets have become so thin, that it is not possible or practical to provide the standard security slot therein because the lock body is thicker than the tablet.

It is a primary objective of the present invention to address the issue of very thin mobile devices, including notebooks, iPads®, tablets, and mobile telephone devices which require securing against theft.

The present invention provides two styles of strips or stick-on components that can be secured to the mobile devices, and which define a security slot which is capable of receiving either the prior art standard 3×7 mm slot locks, or the thinner, more flat locks of the present inventor that are described in the aforementioned U.S. patent application Ser. No. 13/818,557 patent application.

SUMMARY OF THE INVENTION

It is an object of the present invention to provide a security strip which can be placed underneath a very thin tablet or notebook device to define at one end thereof a standard security slot into which a locking element can be inserted to tether the mobile device requiring protection.

It is further an object of the invention to provide a stick-on tab which can be adhered to the underside of the tablet or mobile device requiring to be secured against theft and which defines for the device a standard security slot.

It is a further object of the present invention to provide a security plate which can be placed over a standard security slot while having extending arms or legs that also engage the power plug or similar plus on a device which prevents its removal.

Other features and advantages of the present invention will become apparent from the following description of the invention which refers to the accompanying drawings.

DETAILED DESCRIPTION OF EMBODIMENTS OF THE INVENTION

Figure 1:
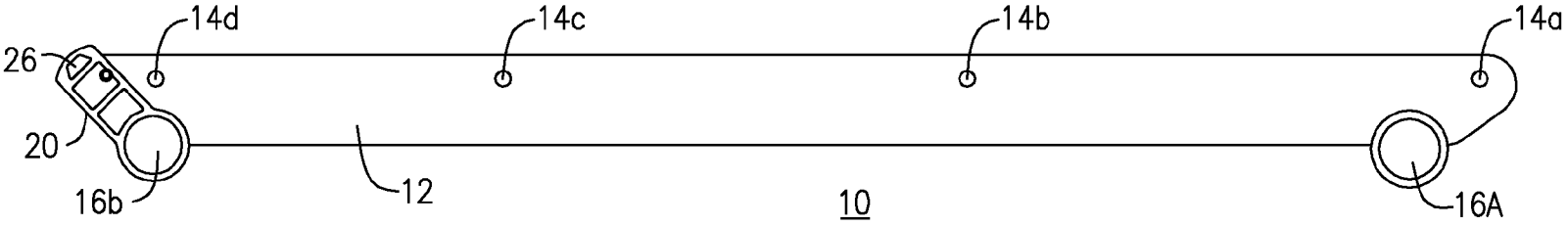
FIG. 1 shows a plane view of a long, ruler-like strip in accordance with a first embodiment of the invention.

Referring to FIG. 1, a thin, strip-like component 10 has a body 12 which measures approximately 14 inches in length, less than an inch in width and approximately a millimeter in thickness. The body 12 of the locking strip 10 is provided with short legs 16*a* and 16*b* and attaching screw holes 14*a*, 14*b*, 14*c* and 14*d*, which are beveled on the screw receiving side. The screws are inserted into the screw holes 14*a*, 14*b*, 14*c* and 14*d*, and the strip 10 can be connected to the bottom of a mobile device, such as a notebook. The notebook will then rest, slightly elevated on the round legs 16*a*, 16*b*, slightly lifting the rear of the notebook.

Figure 2:
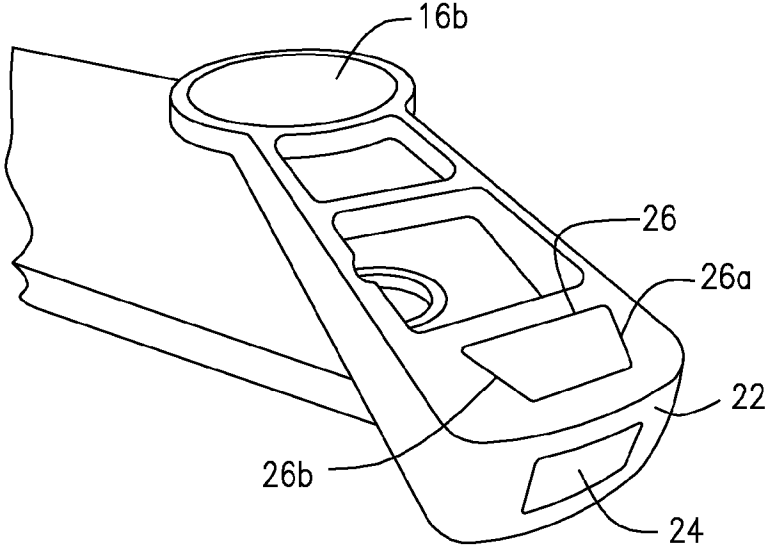
FIG. 2 is a perspective of one of the end regime of the strip of FIG. 1, which defines the security slot.

Of particular significance herein, is the provision at one side of the strip 10, of a security slot defining body 20 which, as shown in FIG. 2, grows gradually in thickness from one side to the other side of the strip body 12. At the wide side is defined a security slot 24 in the surface 22, into which a conventional locking element can be inserted. The security slot 24 is accessible through an opening 26, through which it can be seen that the slot has sidewalls 26*a* and 26*b*, which provide the interior with a trapezoidal shape.

In operation, the strip 10 is connected by screws to the underside of a mobile device, which can be any device to which it is configured to be attached, by providing screw holes corresponding with the position of the screw openings 14*a*, 14*b*, 14*c* and 14*d* and thereby be secured to it via special screws that are not easily removed, for example one-way closure.

In well-known manner, a lock with a cable (FIG. 7) which has a loop 82 at the end is inserted into the security slot 24, and thereby securing the mobile device.

Figure 3:
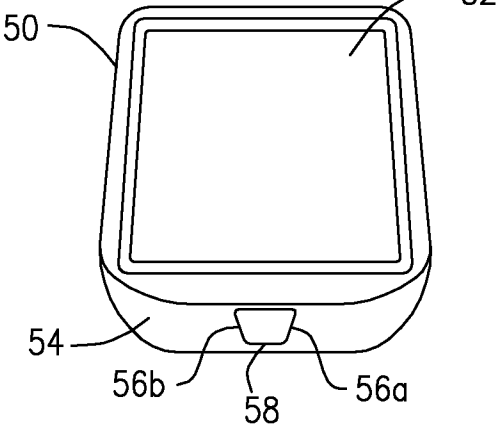
FIG. 3 shows one side of a stick-on, plate-like device which defines the security slot and which can be glued to the underside of either a mobile device, or to the docking station or cover thereof.
Figure 6:
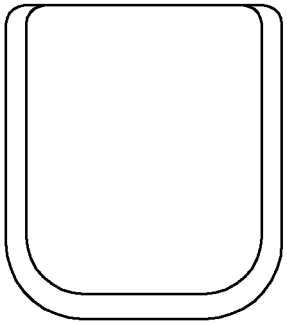
FIG. 6 is a rear view of FIG. 3.
Figure 5:
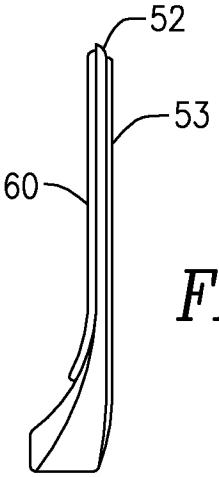
FIG. 5 is a side view of FIG. 3.

In FIG. 3 is shown a small, tab-like, generally flat, rectangular body 50 which is designed to be a stick-on security slot forming body. The stick-on device 50 has a body that is generally flat and preferably measures an inch and a half to two inches in width and length and has a thickness on the order of about a millimeter. Provided on the invisible surface is a stick-on device 60 (FIG. 5), the cover of which can be peeled away, and thereby allowing attaching the stick-on lock defining security slot forming body to the underside of the mobile device.

Figure 4:
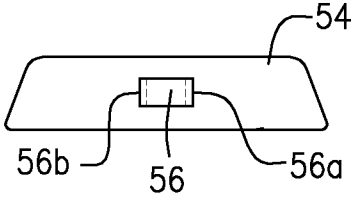
FIG. 4 is an end view of FIG. 3.

At one end, the generally flat body 50 increases in thickness to a thickness of around 10 mm and that section defines a security slot 56 with rectangular opening and tapering walls 56*a* and 56*b*. Inside, the slot has sidewalls 56*a* and 56*b*, which are visible through the viewing access opening 58. See FIGS. 3-5.

Figure 7:
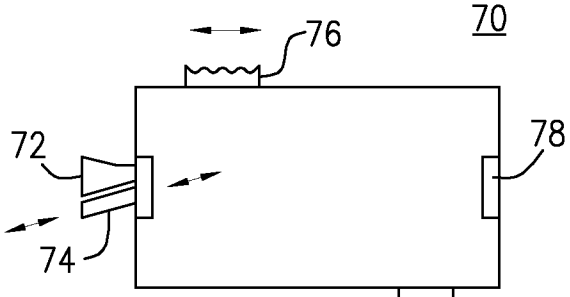
FIG. 7 shows one type of a lock that can be used with the security slot of the foregoing embodiments.
Figure 7:
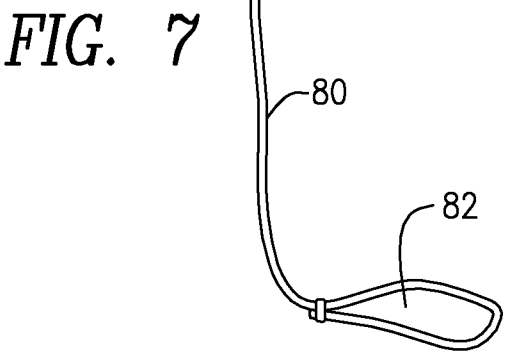

Referring to FIG. 7, the lock 70 has a rectangular lock body, measuring approximately 18×30 mm in width and length and approximately 7 mm in thickness, has a stationary locking element 72, which fits in the opening 56 and which can be locked therein by sliding the locking pin 74 by moving the slider button 76. Once the locking elements 72 and 74 combine inside the locking slot 58, it is impossible to withdraw the lock, which remains securely connected to a cable 80 and has a loop 82, in well-known manner. The numeral 78 indicates the key insertion location.

In departure from the prior art, and as indicated in the previously mentioned incorporated by reference patent application, the size of the opening 56 at its narrowest point at the opening, may measure less than 5 mm, which is an improvement over the 3×7 mm standard slot size. Also, the hole may be a blind hole and the locking elements 72 and 74, once inserted, cannot be rotated inside the opening. Instead, owing to the overall trapezoidal shape, they hug and hold inside against the trapezoidal shape of the opening itself.

The device 50 can be attached to nowadays familiar covers that have been provided for notebooks, cell phones and the like, and such devices can be provided with an undercut area which fits the overall dimension of the device 50 and which, when attached to that undercut area, will not protrude at the bottom of the device outside the general flat area of the body itself.

Figure 8:
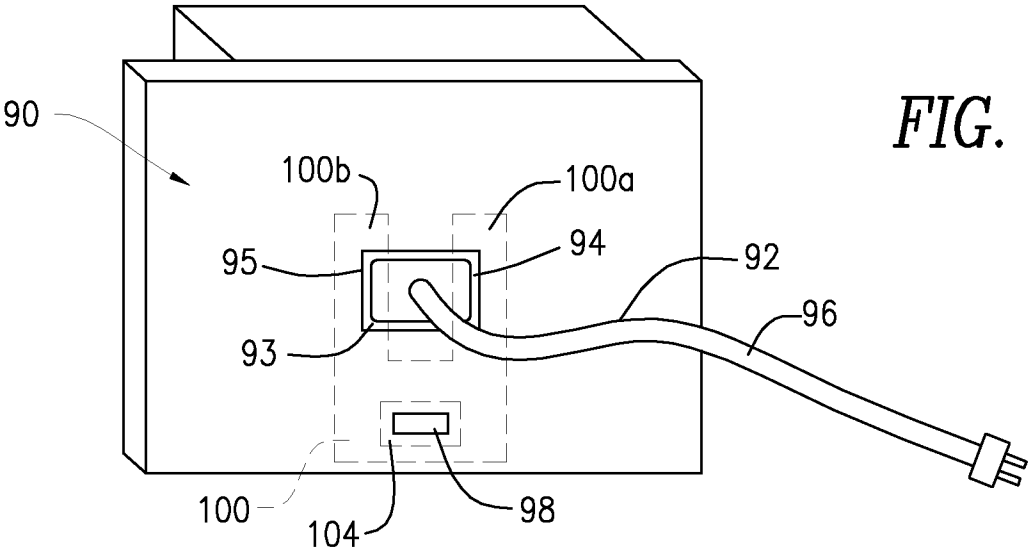
FIG. 8 is a rear view of an existing equipment comprising a security slot.

FIG. 8 shows the rear of a prior art conventional device 90 which has a rear wall 91 with an opening 93 for the insertion therethrough of electrical cable or cables 92 that have an elongated cord 96 that is connected at a distal end to a plug 94 that fits in the rear socket 95 of the device 90.

The rear surface is also provided with a standard security slot, typically at 3×7 mm rectangular slot shown below the opening 93.

As is known in the art, in the prior art device 90, in order to open the rear cover of the device 90, it is necessary to first remove the cable 92. If the cable cannot be removed, the rear wall cover cannot be opened.

Figure 9:
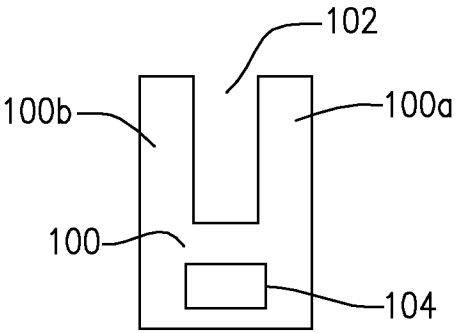
FIG. 9 is a security device operable with the prior art device of FIG. 8.

In accordance with the present invention, and with reference to FIG. 9, the invention provides a security cover plate 100 that is generally yoke shaped at the top with arms 100*a* and 100*b* and a yoke opening 102. The plate 100 also has a slightly oversized 3×7 mm opening 104. Merely placing the cover plate 100 at the rear of the prior art device 90, allows the legs 100*a* and 100*b* to grasp the rear of the cable plug 94 while registering its opening 104 over the security slot 98. When the locking element 72/74 of FIG. 7 or a similar T-shaped bar locking element is inserted through the openings 104 and security slot 98, the security plate 100 cannot be removed. Not only can the device 90 not be removed but also the rear plug cannot be pulled out and no access can be gained to the interior of the device 90.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A security strip attachable to a thin mobile electronic device, the security strip comprising:

a strip body shaped as a thin, strip-shaped component with a length and a thickness dimension wherein the length of the strip body is at least ten times the width of the strip body, and the width of the strip body is at least 20 times the thickness of the strip body;

screw holes defined along the length of the strip body for enabling screwing the strip body to an underside of the mobile electronic device;

a security slot body protruding from the strip body and having a thickened portion thicker than the thickness dimension of the strip body and defining therein a security slot in which a locking element of a locking device is receivable, wherein said security slot has an opening that provides access into said slot, and said opening is rectangularly shaped and said thickened portion has a thickness substantially larger than the thickness of the strip body; and left and right legs formed on the security strip for resting against a support surface of the mobile electronic device and for supporting said mobile electronic device on said left and right legs, wherein each said left and right legs is located nearer a respective one of a left side and a right side of said strip body and wherein the security slot has a trapezoidal shape within, said trapezoidal shape of said slot being defined by first and second sidewalls which abut and define an opening into said slot and said sidewalls tapering away from each other as said sidewalls extend away from said opening.

2. The security strip of claim 1, wherein the security slot opening measures about 3×7 mm.

3. The security strip of claim 1, wherein said opening into the trapezoidal security slot has a length dimension that is not greater than 5 mm.

4. The security strip of claim 1, wherein the security slot body projects away from the strip body at an angle thereto from one side of said strip.

* * * * *